US010494705B2

(12) United States Patent
Cha et al.

(10) Patent No.: US 10,494,705 B2
(45) Date of Patent: Dec. 3, 2019

(54) ULTRA HIGH-STRENGTH SPRING STEEL

(71) Applicants: Hyundai Motor Company, Seoul (KR); Hyundai Steel Company, Incheon (KR)

(72) Inventors: Sung Chul Cha, Seoul (KR); Hyung Oh Ban, Gyeonggi-do (KR); Seung Hyun Hong, Seoul (KR); Chul Woo Park, Chungcheongnam-do (KR)

(73) Assignees: Hyundai Motor Company, Seoul (KR); Hyundai Steel Company, Incheon (KR)

( * ) Notice: Subject to any disclaimer, the term of this patent is extended or adjusted under 35 U.S.C. 154(b) by 313 days.

(21) Appl. No.: 15/179,712

(22) Filed: Jun. 10, 2016

(65) Prior Publication Data

US 2017/0159160 A1 Jun. 8, 2017

(30) Foreign Application Priority Data

Dec. 4, 2015 (KR) ..... 10-2015-0171896

(51) Int. Cl.
*C22C 38/54* (2006.01)
*C22C 38/52* (2006.01)
(Continued)

(52) U.S. Cl.
CPC ..... *C22C 38/52* (2013.01); *C22C 38/001* (2013.01); *C22C 38/002* (2013.01);
(Continued)

(58) Field of Classification Search
None
See application file for complete search history.

(56) References Cited

U.S. PATENT DOCUMENTS 4,770,721 A * 9/1988 Yamamoto ..... C21D 6/02 148/548
5,776,267 A * 7/1998 Nanba ..... C22C 38/44 148/328
(Continued)

FOREIGN PATENT DOCUMENTS

CN 10 2586692 * 7/2012 ..... C22C 38/32
EP 2947168 A1 11/2015
(Continued)

OTHER PUBLICATIONS

Extended European Search Report for European Patent Application No. 16175227.4, dated May 2, 2017, 11 pages.
(Continued)

*Primary Examiner* — Patricia L. Hailey
(74) *Attorney, Agent, or Firm* — Mintz Levin Cohn Ferris Glovsky and Popeo, P.C.; Peter F. Corless

(57) ABSTRACT

A steel composition is provided and includes carbon of about 0.5 to 0.7 wt %; silicon of about 1.3 to 2.3 wt %; manganese of about 0.6 to 1.2%; chromium of about 0.6 to 1.2 wt %; molybdenum of about 0.1 to 0.5 wt %; nickel of about 0.05 to 0.8 wt %; vanadium of about 0.05 to 0.5 wt %; niobium of about 0.05 to 0.5 wt %; titanium of about 0.05 to 0.3 wt %; cobalt of about 0.01 to 3 wt %; zirconium of about 0.001 to 0.2 wt %; yttrium of about 0.01 to 1.5 wt %; copper of about 0.3% or less but greater than 0 wt %; aluminum of about 0.3% or less but greater than 0 wt %; nitrogen of about 0.03% or less but greater than 0 wt %; oxygen of about 0.003% or less but greater than 0 wt %. Additionally, a balance iron, based on the total weight is included.

9 Claims, 4 Drawing Sheets

| wt .% | yield strength (MPa) | tensile strength (MPa) | hardness (HV) | fatigue strength (MPa) | moldability | fatigue life | inclusion regulation | improvement in carbon fraction by > 7% and in carbon activity by > 3% |
|---|---|---|---|---|---|---|---|---|
| conventional steel | 1950 | 2346 | 619 | 841 | Pass | 29 x $10^4$ cycles | Pass | X |
| Ex. 1 | 2549 | 3082 | 785 | 1262 | Pass | 55 x $10^4$ cycles | Pass | O |
| Ex. 2 | 2551 | 3098 | 783 | 1264 | Pass | 57 x $10^4$ cycles | Pass | O |
| Ex. 3 | 2555 | 3041 | 779 | 1272 | Pass | 59 x $10^4$ cycles | Pass | O |
| C. Ex. 1 | 1978 | 2375 | 618 | 826 | Pass | 21 x $10^4$ cycles | Pass | X |
| C. Ex. 2 | 2353 | 2925 | 728 | 965 | Pass | 45 x $10^4$ cycles | Pass | O |
| C. Ex. 3 | 2217 | 2559 | 693 | 1025 | Pass | 41 x $10^4$ cycles | Pass | O |
| C. Ex. 4 | 2198 | 2542 | 672 | 1010 | Pass | 28 x $10^4$ cycles | Pass | O |
| C. Ex. 5 | 2165 | 2576 | 677 | 855 | Pass | 27 x $10^4$ cycles | Pass | X |
| C. Ex. 6 | 2225 | 2580 | 715 | 840 | Pass | 25 x $10^4$ cycles | Fail | O |
| C. Ex. 7 | 2132 | 2618 | 695 | 975 | Pass | 27 x $10^4$ cycles | Pass | X |
| C. Ex. 8 | 2246 | 2592 | 674 | 1020 | Pass | 33 x $10^4$ cycles | Pass | O |
| C. Ex. 9 | 2065 | 2495 | 662 | 810 | Pass | 22 x $10^4$ cycles | Pass | X |
| C. Ex. 10 | 2270 | 2480 | 632 | 956 | Pass | 35 x $10^4$ cycles | Pass | O |
| C. Ex. 11 | 2343 | 2805 | 733 | 1045 | Fail | 43 x $10^4$ cycles | Fail | O |
| C. Ex. 12 | 2272 | 2612 | 679 | 985 | Pass | 27 x $10^4$ cycles | Pass | O |
| C. Ex. 13 | 2185 | 2625 | 674 | 1060 | Pass | 29 x $10^4$ cycles | Pass | O |
| C. Ex. 14 | 2355 | 2732 | 726 | 949 | Pass | 41 x $10^4$ cycles | Pass | X |
| C. Ex. 15 | 2196 | 2652 | 718 | 864 | Pass | 49 x $10^4$ cycles | Pass | O |
| C. Ex. 16 | 1995 | 2296 | 605 | 977 | Fail | 29 x $10^4$ cycles | Fail | O |

(51) Int. Cl.

| | |
|---|---|
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/34*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***F01L 1/46*** | (2006.01) |

(52) U.S. Cl.

CPC ..... *C22C 38/005* (2013.01); *C22C 38/02* (2013.01); *C22C 38/04* (2013.01); *C22C 38/06* (2013.01); *C22C 38/34* (2013.01); *C22C 38/42* (2013.01); *C22C 38/44* (2013.01); *C22C 38/46* (2013.01); *C22C 38/48* (2013.01); *C22C 38/50* (2013.01); *F01L 1/462* (2013.01); *F01L 2101/00* (2013.01)

(56) References Cited

U.S. PATENT DOCUMENTS

| | | | | |
|---|---|---|---|---|
| 6,277,220 | B1 | 8/2001 | Hamada et al. | |
| 6,322,747 | B1 * | 11/2001 | Fukuzumi | C22C 38/34 148/332 |
| 7,789,974 | B2 * | 9/2010 | Hashimura | B32B 17/10018 148/320 |
| 2008/0279714 | A1 | 11/2008 | Hashimura et al. | |
| 2008/0308195 | A1 | 12/2008 | Yoshihara et al. | |
| 2009/0007998 | A1 | 1/2009 | Kochi et al. | |
| 2009/0065105 | A1 | 3/2009 | Kochi et al. | |
| 2009/0092516 | A1 | 4/2009 | Hashimura et al. | |
| 2009/0205753 | A1 | 8/2009 | Hashimura et al. | |
| 2010/0028196 | A1 | 2/2010 | Hashimura et al. | |
| 2013/0127100 | A1 | 5/2013 | Ishida et al. | |
| 2015/0369322 | A1 | 12/2015 | Sugimura et al. | |
| 2016/0053352 | A1 | 2/2016 | Aono et al. | |
| 2017/0044633 | A1 | 2/2017 | Hashimura et al. | |
| 2017/0298486 | A1 * | 10/2017 | Cha | C22C 38/52 |

FOREIGN PATENT DOCUMENTS

| | | | | |
|---|---|---|---|---|
| JP | H05-148581 | A | 6/1993 | |
| JP | H05-214489 | A | 8/1993 | |
| JP | 2006-028599 | A | 2/2006 | |
| JP | 2006-183137 | A | 7/2006 | |
| JP | 2012-072492 | A | 4/2012 | |
| JP | 5200540 | B2 | 6/2013 | |
| JP | 2015-120940 | A | 7/2015 | |
| KR | 10-0213542 | B1 | 8/1999 | |
| KR | 10-2002-0083181 | A | 11/2002 | |
| KR | 2008-0009699 | A | 1/2008 | |
| KR | 2008-0009713 | A | 1/2008 | |
| KR | 2008-0057205 | A | 6/2008 | |
| KR | 100851083 | B1 | 8/2008 | |
| KR | 10-2008-0111688 | A | 12/2008 | |
| KR | 10-2009-0071163 | A | 7/2009 | |
| KR | 2010-0004352 | A | 1/2010 | |
| KR | 10-2010-0019603 | A | 2/2010 | |
| KR | 10-0968938 | B1 | 7/2010 | |
| KR | 2010-0077250 | A | 7/2010 | |
| KR | 2010-0103243 | A | 9/2010 | |
| KR | 10-2011-0075318 | A | 7/2011 | |
| KR | 10-1401625 | B1 | 6/2014 | |
| KR | 2015-0093210 | A | 8/2015 | |
| SU | 1184867 | * | 10/1985 | C22C 38/54 |
| WO | 2015-162928 | A1 | 10/2015 | |

OTHER PUBLICATIONS

Office Action for U.S. Appl. No. 15/342,636, dated Jul. 26, 2018, 31 pages.

H. Villasenor-Ochoa, "Engineering Fundamentals Refresh: Strength vs Stiffness vs Hardness", taken from https://www.fictiv.com/hwg/design/engineering-fundamentals-refresh-strength-vs-stiffness-vs-hardness, Feb. 15, 2017, 12 pages.

Bossard, "Difference Between Hardness and Strength in Steel", taken from https://web.archive.org/web/20160805211012/https://provenproductivity.com/difference-between-hardness-and-strength-in-steel/, 1 page (2016).

"Non-Final Office Action Received for U.S. Appl. No. 15/342,811", dated Jun. 13, 2019, 22 pages.

* cited by examiner

| wt.% | C | Si | Mn | Cr | Mo | Ni | V | Nb | Ti | CO | Zr | Y | Cu | Al | N | O |
|---|---|---|---|---|---|---|---|---|---|---|---|---|---|---|---|---|
| conventional steel | 0.55 | 0.45 | 0.71 | 0.72 | – | – | – | – | – | – | – | | 0.05 | 0.0017 | 0.0022 | 0.0015 |
| Ex. 1 | 0.65 | 1.58 | 0.64 | 0.93 | 0.13 | 0.07 | 0.08 | 0.48 | 0.06 | 0.02 | 0.18 | 0.016 | 0.054 | 0.008 | 0.0018 | 0.0006 |
| Ex. 2 | 0.66 | 1.34 | 0.76 | 0.83 | 0.32 | 0.22 | 0.33 | 0.24 | 0.18 | 1.55 | 0.002 | 1.48 | 0.067 | 0.019 | 0.0012 | 0.0014 |
| Ex. 3 | 0.68 | 2.17 | 1.19 | 1.14 | 0.48 | 0.78 | 0.49 | 0.05 | 0.27 | 2.86 | 0.015 | 0.88 | 0.043 | 0.012 | 0.0017 | 0.0015 |
| C. Ex. 1 | 0.58 | 1.54 | 0.65 | 0.93 | 0.06 | 0.36 | 0.13 | 0.08 | 0.09 | 0.05 | 0.12 | 0.08 | 0.046 | 0.014 | 0.0012 | 0.0007 |
| C. Ex. 2 | 0.67 | 1.36 | 0.73 | 0.78 | 0.51 | 0.75 | 0.19 | 0.23 | 0.14 | 1.13 | 0.14 | 1.25 | 0.043 | 0.016 | 0.0011 | 0.0011 |
| C. Ex. 3 | 0.65 | 1.61 | 1.19 | 1.14 | 0.46 | 0.83 | 0.46 | 0.47 | 0.23 | 1.44 | 0.15 | 0.55 | 0.08 | 0.011 | 0.0012 | 0.0014 |
| C. Ex. 4 | 0.56 | 1.63 | 0.61 | 0.85 | 0.16 | 0.03 | 0.35 | 0.12 | 0.18 | 1.73 | 0.14 | 0.89 | 0.014 | 0.007 | 0.0011 | 0.0025 |
| C. Ex. 5 | 0.65 | 2.25 | 0.73 | 0.74 | 0.33 | 0.36 | 0.04 | 0.28 | 0.13 | 0.06 | 0.04 | 1.32 | 0.06 | 0.013 | 0.0012 | 0.0006 |
| C. Ex. 6 | 0.66 | 2.24 | 1.18 | 1.16 | 0.43 | 0.79 | 0.51 | 0.48 | 0.24 | 2.52 | 0.05 | 0.019 | 0.043 | 0.014 | 0.0017 | 0.0014 |
| C. Ex. 7 | 0.68 | 1.41 | 0.74 | 0.78 | 0.14 | 0.35 | 0.44 | 0.03 | 0.05 | 1.82 | 0.17 | 0.35 | 0.067 | 0.011 | 0.0015 | 0.0011 |
| C. Ex. 8 | 0.64 | 2.17 | 1.16 | 1.19 | 0.38 | 0.74 | 0.15 | 0.52 | 0.18 | 2.94 | 0.007 | 0.42 | 0.043 | 0.014 | 0.0012 | 0.0014 |
| C. Ex. 9 | 0.56 | 1.94 | 0.77 | 0.94 | 0.22 | 0.33 | 0.24 | 0.25 | 0.04 | 0.95 | 0.05 | 0.05 | 0.046 | 0.01 | 0.0011 | 0.0019 |
| C. Ex. 10 | 0.64 | 1.59 | 0.72 | 0.75 | 0.36 | 0.73 | 0.45 | 0.16 | 0.31 | 2.99 | 0.11 | 1.33 | 0.054 | 0.009 | 0.0012 | 0.0008 |
| C. Ex. 11 | 0.63 | 1.45 | 0.65 | 0.75 | 0.14 | 0.34 | 0.43 | 0.44 | 0.07 | 0.008 | 0.006 | 0.26 | 0.067 | 0.014 | 0.0017 | 0.0012 |
| C. Ex. 12 | 0.65 | 1.88 | 1.19 | 1.18 | 0.36 | 0.72 | 0.35 | 0.07 | 0.14 | 3.09 | 0.19 | 1.47 | 0.043 | 0.012 | 0.0012 | 0.0009 |
| C. Ex. 13 | 0.59 | 1.98 | 0.99 | 0.96 | 0.19 | 0.38 | 0.46 | 0.28 | 0.19 | 0.42 | 0.0009 | 0.013 | 0.046 | 0.013 | 0.0014 | 0.0012 |
| C. Ex. 14 | 0.61 | 1.64 | 0.81 | 0.79 | 0.37 | 0.64 | 0.43 | 0.16 | 0.21 | 0.15 | 0.22 | 0.77 | 0.043 | 0.014 | 0.0016 | 0.0013 |
| C. Ex. 15 | 0.63 | 1.42 | 0.64 | 0.65 | 0.44 | 0.77 | 0.37 | 0.14 | 0.19 | 1.62 | 0.18 | 0.007 | 0.08 | 0.021 | 0.0021 | 0.0022 |
| C. Ex. 16 | 0.64 | 1.93 | 1.12 | 1.05 | 0.16 | 0.54 | 0.08 | 0.39 | 0.25 | 0.09 | 0.045 | 1.54 | 0.014 | 0.028 | 0.0005 | 0.0012 |

FIG. 1

| wt .% | yield strength (MPa) | tensile strength (MPa) | hardness (HV) | fatigue strength (MPa) | moldability | fatigue life | inclusion regulation | Improvement in carbon fraction by > 7% and in carbon activity by > 8% |
|---|---|---|---|---|---|---|---|---|
| conventional steel | 1860 | 2345 | 618 | 841 | Pass | $23 \times 10^4$ cycles | Pass | X |
| Ex. 1 | 2549 | 3082 | 765 | 1262 | Pass | $55 \times 10^4$ cycles | Pass | O |
| Ex. 2 | 2551 | 3098 | 763 | 1264 | Pass | $57 \times 10^4$ cycles | Pass | O |
| Ex. 3 | 2555 | 3041 | 778 | 1272 | Pass | $58 \times 10^4$ cycles | Pass | O |
| C. Ex. 1 | 1973 | 2375 | 618 | 825 | Pass | $21 \times 10^4$ cycles | Pass | X |
| C. Ex. 2 | 2353 | 2825 | 728 | 965 | Pass | $45 \times 10^4$ cycles | Pass | O |
| C. Ex. 3 | 2217 | 2650 | 693 | 1025 | Pass | $41 \times 10^4$ cycles | Pass | O |
| C. Ex. 4 | 2196 | 2642 | 672 | 1010 | Pass | $28 \times 10^4$ cycles | Pass | O |
| C. Ex. 5 | 2165 | 2576 | 677 | 855 | Pass | $27 \times 10^4$ cycles | Pass | X |
| C. Ex. 6 | 2225 | 2680 | 715 | 840 | Pass | $25 \times 10^4$ cycles | Fail | O |
| C. Ex. 7 | 2132 | 2618 | 695 | 975 | Pass | $27 \times 10^4$ cycles | Pass | X |
| C. Ex. 8 | 2245 | 2692 | 674 | 1020 | Pass | $33 \times 10^4$ cycles | Pass | O |
| C. Ex. 9 | 2065 | 2495 | 662 | 810 | Pass | $22 \times 10^4$ cycles | Pass | X |
| C. Ex. 10 | 2270 | 2480 | 632 | 956 | Pass | $35 \times 10^4$ cycles | Pass | O |
| C. Ex. 11 | 2343 | 2805 | 733 | 1045 | Fail | $43 \times 10^4$ cycles | Fail | O |
| C. Ex. 12 | 2272 | 2612 | 679 | 985 | Pass | $27 \times 10^4$ cycles | Pass | O |
| C. Ex. 13 | 2185 | 2625 | 674 | 1060 | Pass | $29 \times 10^4$ cycles | Pass | O |
| C. Ex. 14 | 2355 | 2732 | 725 | 949 | Pass | $41 \times 10^4$ cycles | Pass | X |
| C. Ex. 15 | 2196 | 2652 | 718 | 864 | Pass | $49 \times 10^4$ cycles | Pass | O |
| C. Ex. 16 | 1995 | 2296 | 605 | 977 | Fail | $29 \times 10^4$ cycles | Fail | O |

FIG. 2

ULTRA HIGH-STRENGTH SPRING STEEL

CROSS REFERENCE TO RELATED APPLICATION

The present application claims priority to Korean Patent Application No. 10-2015-0171896, filed Dec. 4, 2015, the entire contents of which is incorporated herein for all purposes by this reference.

TECHNICAL FIELD

The present invention relates to a steel composition that constitutes an ultra high-strength steel. The steel composition for the ultra high-strength steel has improved tensile strength and fatigue strength suitable for use as an engine valve spring of a vehicle.

BACKGROUND

With the decline of fossil fuel reserves and the sudden increase and change of oil prices, research is being conducted for an improvement in the fuel efficiency of vehicles. Important for fuel efficiency improvement are the weight reduction design of vehicle bodies and the minimization of power loss by reducing frictions at system links. Additionally, the maximization of output efficiency by improving dynamic characteristics upon the exhaustion control of the engine itself contributes to fuel efficiency. In regard to the improvement of fuel efficiency, research has been conducted to reduce a dynamic load through the weight reduction of dynamic components of the engine head.

Of the dynamic components, an engine valve spring of a vehicle is a component that contributes to fuel efficiency when the weight thereof is reduced, because it directly controls a dynamic load. Conventionally, valve springs have been made mainly of chromium silicide (CrSi) steel that has a tensile strength of 1900 MPa or chromium silicide vanadium (CrSiV) steel that has a tensile strength of 2100 MPa. Recently, attempts have been made to increase the tensile strength of the steel for the engine valve spring to a level of 2550 MPa by adding alloy elements to CrSiV steels.

SUMMARY OF THE INVENTION

The present invention provides a steel composition, particularly a steel composition for a ultra high-strength spring steel. Accordingly, tensile strength may be substantially improved by optimizing contents of molybdenum (Mo), nickel (Ni), vanadium (V), niobium (Nb), titanium (Ti), cobalt (Co), zirconium (Zr), and yttrium (Y) and fatigue strength may be improved by adjusting inclusions formed therein.

In one aspect, the present invention provides a steel composition. The steel composition may be used in an ultra high-strength spring steel suitable for use as a valve spring steel in a vehicle engine. The steel composition may include: carbon (C) in an amount of about 0.5 to 0.7 wt %, silicon (Si) in an amount of about 1.3 to 2.3 wt %; manganese (Mn) in an amount of about 0.6 to 1.2%; chromium (Cr) in an amount of about 0.6 to 1.2 wt %; molybdenum (Mo) in an amount of about 0.1 to 0.5 wt %; nickel (Ni) in an amount of about 0.05 to 0.8 wt %; vanadium (V) in an amount of about 0.05 to 0.5 wt %; niobium (Nb) in an amount of about 0.05 to 0.5 wt %; titanium (Ti) in an amount of about 0.05 to 0.3 wt %; cobalt (Co) in an amount of about 0.01 to 3 wt %; zirconium (Zr) in an amount of about 0.001 to 0.2 wt %; yttrium (Y) in an amount of about 0.01 to 1.5 wt %; copper (Cu) in an amount of about 0.3% or less but greater than 0 wt %; aluminum (Al) in an amount of about 0.3% or less but greater than 0 wt %; nitrogen (N) in an amount of about 0.03% or less but greater than 0 wt %; oxygen (0) in an amount of about 0.003% or less but greater than 0 wt %; and iron (Fe) constituting the remaining balance of the steel composition. All the wt % presented herein are based on the total weight of the steel composition.

Preferably, the spring steel may have a tensile strength of about 3000 MPa or greater. Preferably, the spring steel may have a fatigue strength of about 1200 MPa or greater. Preferably, the spring steel may have a yield strength of about 2500 MPa or greater. Preferably, the spring steel may have a hardness of about 750 HV or greater. Preferably, the spring steel may comprise inclusions having a size of about 15 μm or less.

In particular, a fraction of about 10% or less of the inclusions has a size of about 10 to 15 μm and a fraction of about 90% or greater of the inclusions has a size of about 10 μm.

The term "inclusion" as used herein refers to alloy particles or distinctive alloy substances formed as being embedded in other materials (e.g. matrix). Preferably, the inclusion may be formed to have distinctive boundaries between the inclusion body and the matrix, thereby provide additional properties to the matrix. For instance, the components of the steel composition as described herein may form inclusions, such as carbide compound comprising the transition metal elements and nitride compounds comprising the transition metal elements, such that those inclusions may be formed in distinctive particles having ranges of sizes. In particular, the inclusions may provide suitably physical or chemical properties, such as hardenability, strength by suppressing softening, fracture toughness, and the like.

The present invention also provides a steel composition that may consist of, consist essentially of, or essentially consist of the above-described components. For instance, the steel composition may consist of, consist essentially of, or essentially consist of: carbon (C) in an amount of about 0.5 to 0.7 wt %, silicon (Si) in an amount of about 1.3 to 2.3 wt %; manganese (Mn) in an amount of about 0.6 to 1.2%; chromium (Cr) in an amount of about 0.6 to 1.2 wt %; molybdenum (Mo) in an amount of about 0.1 to 0.5 wt %; nickel (Ni) in an amount of about 0.05 to 0.8 wt %; vanadium (V) in an amount of about 0.05 to 0.5 wt %; niobium (Nb) in an amount of about 0.05 to 0.5 wt %; titanium (Ti) in an amount of about 0.05 to 0.3 wt %; cobalt (Co) in an amount of about 0.01 to 3 wt %; zirconium (Zr) in an amount of about 0.001 to 0.2 wt %; yttrium (Y) in an amount of about 0.01 to 1.5 wt %; copper (Cu) in an amount of about 0.3% or less but greater than 0 wt %; aluminum (Al) in an amount of about 0.3% or less but greater than 0 wt %; nitrogen (N) in an amount of about 0.03% or less but greater than 0 wt %; oxygen (O) in an amount of about 0.003% or less but greater than 0 wt %; and iron (Fe) constituting the remaining balance of the steel composition. All the wt % presented herein are based on the total weight of the steel composition.

Further provided is a spring steel that may comprise the steel composition as described herein.

Still further provided is a vehicle part that may comprise the steel composition as described herein. The vehicle part may be a valve spring made of the steep composition or the spring steel above in a vehicle engine.

Other aspects of the invention are disclosed herein.

BRIEF DESCRIPTION OF THE DRAWINGS

The above and other objects, features and advantages of the present invention will be more clearly understood from the following detailed description taken in conjunction with the accompanying drawings, in which:

FIG. 1 is a table showing components of the steel compositions of Examples and Comparative Examples;

FIG. 2 is a table showing physical properties and performances of the steels made from the steel compositions of Examples and Comparative Examples from FIG. 1;

DETAILED DESCRIPTION

The terminology used herein is for the purpose of describing particular exemplary embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

For illustrative purposes, the principles of the present invention are described by referencing various exemplary embodiments. Although those exemplary embodiments of the present invention are specifically described herein, one of ordinary skill in the art will readily recognize that the same principles are equally applicable to, and can be employed in other systems and methods. Before explaining the disclosed embodiments of the present invention in detail, it is to be understood that the disclosure is not limited in its application to the details of any particular embodiment shown. Additionally, the terminology used herein is for the purpose of description and not of limitation. Furthermore, although certain methods are described with reference to steps that are presented herein in a certain order, in many instances, these steps may be performed in any order as may be appreciated by one skilled in the art; the novel method is therefore not limited to the particular arrangement of steps disclosed herein.

Figure 3:
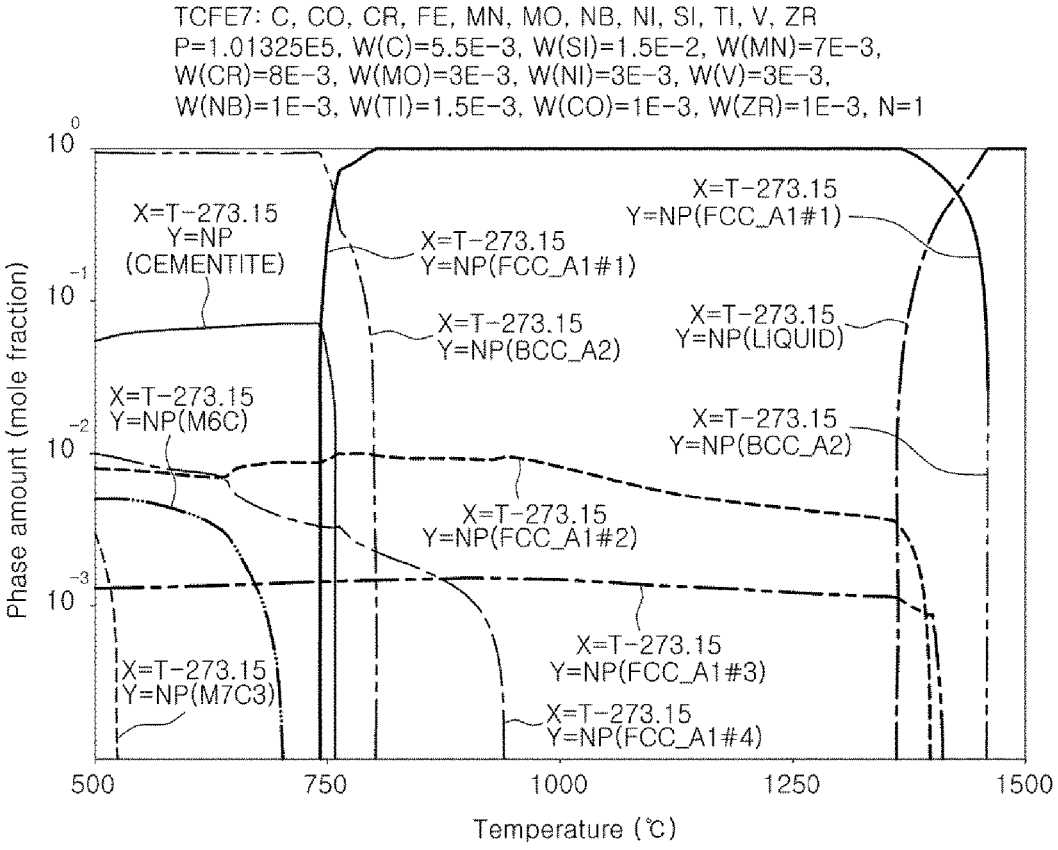
FIG. 3 is a graph showing the phase transformation of a steel at various temperatures according to an exemplary embodiment of the present invention.
Figure 4:
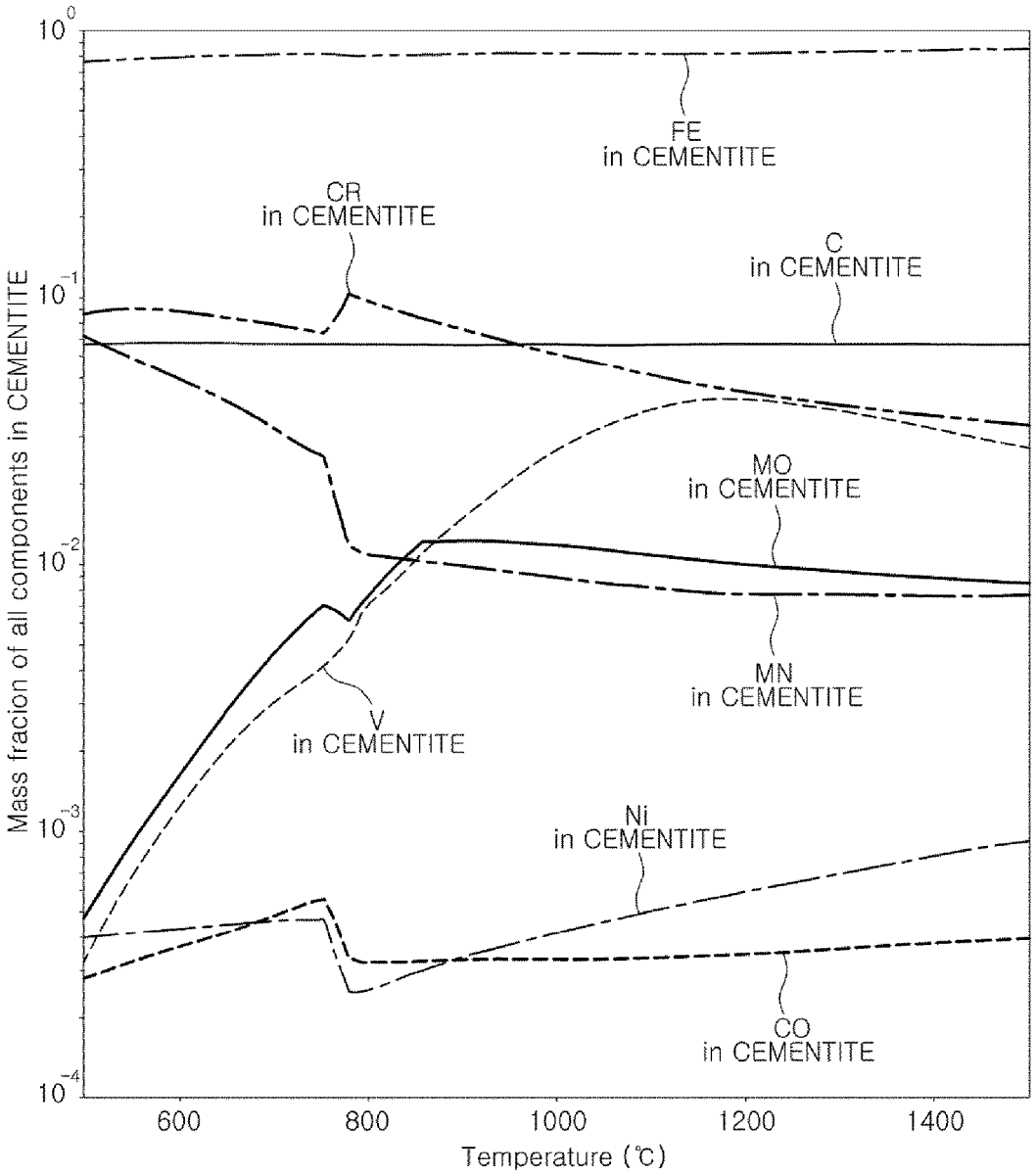
FIG. 4 is a graph showing the phase transformation of an exemplary steel composition into cementite at various temperatures according to an exemplary embodiment of the present invention.

FIG. 3 is a graph showing the phase transformation at various temperatures of an exemplary steel composition constituting the ultra high-strength spring steel according to an exemplary embodiment of the present invention, and FIG. 4 is a graph showing the phase transformation into cementite at various temperatures of an exemplary steel composition constituting the ultra high-strength spring steel according to an exemplary embodiment of the present invention.

The steel composition for the ultra high-strength spring steel, which is suitable for use as a valve spring steel in a vehicle engine, may have substantially improved properties such as tensile strength and fatigue strength as contents of its main alloy components are optimized. In particular, the steel composition according to an exemplary embodiment of the present invention may comprise: carbon (C) in an amount of about 0.5 to 0.7 wt %, silicon (Si) in an amount of about 1.3 to 2.3 wt %; manganese (Mn) in an amount of about 0.6 to 1.2%; chromium (Cr) in an amount of about 0.6 to 1.2 wt %; molybdenum (Mo) in an amount of about 0.1 to 0.5 wt %; nickel (Ni) in an amount of about 0.05 to 0.8 wt %; vanadium (V) in an amount of about 0.05 to 0.5 wt %; niobium (Nb) in an amount of about 0.05 to 0.5 wt %; titanium (Ti) in an amount of about 0.05 to 0.3 wt %; cobalt (Co) in an amount of about 0.01 to 3 wt %; zirconium (Zr) in an amount of about 0.001 to 0.2 wt %; yttrium (Y) in an amount of about 0.01 to 1.5 wt %; copper (Cu) in an amount of about 0.3% or less but greater than 0 wt %; aluminum (Al) in an amount of about 0.3% or less but greater than 0 wt %; nitrogen (N) in an amount of about 0.03% or less but greater than 0 wt %; oxygen (O) in an amount of about 0.003% or less but greater than 0 wt %; and iron (Fe) constituting the remaining balance of the steel composition.

Below, reasons for numerical limitations of the components in the composition according to the present invention will be described. Unless described otherwise, the unit wt % given in the following description means % by weight based on the total weight of the steel composition.

Carbon (C), as used herein, may be contained in an amount of about 0.5 to 0.7 wt % based on the total weight of the steel composition. The strength of steel may increase with an increase in carbon content. When a carbon content is less than about 0.5 wt %, the steel may slightly increase in strength due to insufficient quenching properties upon heat treatment. On the other hand, when a carbon content is greater than about 0.7 wt %, the formation of the martensitic phase may be induced upon quenching, resulting in a decrease in fatigue strength and toughness. Within the range, the steel may be provided with high strength and ductility.

Silicon (Si), as used herein, may be contained in an amount of about 1.3 to 2.3 wt % based on the total weight of the steel composition. When a solid solution is formed in ferrite with iron, silicon may increase strength and temper softening resistance. When a silicon content is less than about 1.3 wt %, the steel may have reduced temper softening resistance. On the other hand, when a silicon content is greater than about 2.3 wt %, decarburizing may occur upon heat treatment.

Manganese (Mn), as used herein, may be contained in an amount of about 0.6 to 1.2 wt % based on the total weight of the steel composition. When a solid solution is formed in the matrix, manganese may function to improve bending fatigue strength and quenching properties. When manganese is included in an amount less than about 0.6 wt %, manganese may not guarantee quenching properties. When the manganese content is greater than about 1.2 wt %, toughness may deteriorate.

Chromium (Cr), as used herein, may be contained in an amount of about 0.6 to 1.2 wt % based on the total weight of the steel composition. Chromium may have various functions, for example, inducing the formation of carbide deposits useful for toughness upon tempering, improving hardenability, and increasing strength by suppressing softening. In addition, toughness of the steel may be improved by microstructural refinement from the chromium content. When a content of chromium is of about 0.6 wt % or greater, chromium may improve temper softening, decarburizing, quenching, and corrosion resistance. When the chromium content is greater than about 1.2 wt %, substantial grain boundary carbides may be excessively formed, thereby deteriorating strength and increase in brittleness.

Molybdenum (Mo), as used herein, may be contained in an amount of about 0.1 to 0.5 wt % based on the total weight of the steel composition. Like chromium, molybdenum may form microstructural carbide deposits to improve strength and fracture toughness. Particularly, the uniform formation of TiMoC having a size of about 1 to 5 nm may improve tempering resistance and guarantees thermal resistance and high strength. When the molybdenum is used in an amount less than about 0.1 wt %, molybdenum may not form carbides, thereby failing to acquire sufficient strength. On the other hand, when the molybdenum content is greater than about 0.5 wt %, cost may increase since the carbide deposits and the strength improvement effects are already saturated.

Nickel (Ni), as used herein, may be contained in an amount of about 0.05 to 0.8 wt % based on the total weight of the steel composition. Nickel may provide corrosion resistance of the steel and improve thermal resistance, cold shortness, hardenability, dimensional stability, and settability. When a nickel content is less than about 0.05 wt %, the steel may have deteriorated corrosion resistance and high-temperature stability. On the other hand, when the nickel content is greater than about 0.8 wt %, the steel may undergo red shortness.

Vanadium (V), as used herein, may be contained in an amount of about 0.05 to 0.5 wt % based on the total weight of the steel composition. Vanadium may improve microstructural refinement, tempering resistance, dimensional stability, and settability, and improve thermal resistance and high strength. In addition, vanadium may form a microstructural deposit vanadium carbide (VC) to increase fractural toughness. Particularly, the microstructural deposit VC may restrain the migration of grain boundaries. V may be dissolved upon austenizing to form a solid solution, and may be deposited upon tempering to generate secondary hardening. When a vanadium content is less than about 0.05 wt %, the fractural toughness may be not prevented from decreasing. When the vanadium content is greater than about 0.5 wt %, the steel may contain coarse deposits and decrease in strength after quenching.

Niobium (Nb), as used herein, may be contained in an amount of about 0.05 to 0.5 wt % based on the total weight of the steel composition. Niobium may induce microstructural refinement, harden the steel surface through nitrization, and improve dimensional stability. The formation of niobium carbide (NbC) may increase the steel strength, and control formation rates of other carbides (e.g., CrC, VC, TiC, MoC). When a niobium content is less than about 0.05 wt %, the steel may decrease in strength and may have a non-uniform distribution of the carbide. When the niobium content is greater than about 0.5 wt %, the formation of other carbides may be restrained.

Titanium (Ti), as used herein, may be contained in an amount of about 0.05 to 0.3 wt % based on the total weight of the steel composition. Like Nb and Al, titanium may prevent or restrain grain recrystallization and growth. In addition, titanium may form nanocarbides such as TiC, TiMoC, and the like, and react with nitrogen to form titanium nitride (TiN) that restrains grain growth. Further, titanium may form $TiB_2$ that interferes with binding between B and N, thereby minimizing the BN-induced quenching property degradation. When a titanium content is less than about 0.05 wt %, other inclusions such as $Al_2O_3$ may be formed, thus decreasing fatigue endurance. When the titanium content is greater than about 0.3 wt %, titanium may interfere with the roles of other alloy elements and thus cost may increase.

Zirconium (Zr), as used herein, may be contained in an amount of about 0.001 to 0.2 wt % based on the total weight of the steel composition. Zirconium may be added to form a deposit, remove N, O, and S, prolong the longevity of the steel, and reduce the size of non-metallic inclusions. When a Zr content is less than about 0.001 wt %, the non-metallic inclusions may increase in size without the formation of the carbide. When the Zr content is greater than about 0.2 wt %, $ZrO_2$ may be excessively formed cost may increase since the strength improvement effect is already saturated.

Yttrium (Y), as used herein, may be contained in an amount of about 0.01 to 1.5 wt % based on the total weight of the steel composition. Yttrium may increase high-temperature stability and improve thermal resistance and toughness. When the alloy is exposed to a high temperature, yttrium may form an oxide preventive of oxidation and corrosion on the surface of the alloy to improve burning resistance and chemical resistance. When a yttrium content is less than about 0.001 wt %, the high-temperature stability may be deteriorated. On the other hand, when the yttrium content is greater than about 1.5 wt %, production cost may increase substantially, solderbility may be reduced, and non-uniformity may occur during steel manufacturing.

Copper (Cu), as used herein, may be contained in an amount of about 0.3 wt % or less but greater than 0 wt % based on the total weight of the steel composition. Copper may increase quenching properties, and strength after tempering, and improve the corrosion resistance of the steel. A copper content may be advantageously limited to 0.3% or less since an excess of copper may increase the production cost.

Aluminum (Al), as used herein, may be contained in an amount of about 0.3 wt % or less but greater than 0 wt % based on the total weight of the steel composition. Aluminum may form aluminum nitride (AlN) with nitrogen to induce the refinement of austenite and to improve strength and impact toughness. Particularly, the addition of aluminum together with Nb, Ti, and Mo may reduce the amount of expensive elements, for example, vanadium for microstructural refinement, and nickel for toughness improvement. However, the content of aluminum may be limited to about 0.3 wt % or less since an excess of aluminum weakens the steel.

Nitrogen (N) as used herein may be contained in an amount of about 0.03 wt % or less but greater than 0 wt % based on the total weight of the steel composition. Nitrogen may form AlN and TiN with Al and Ti, respectively, thereby providing microstructural refinement. Particularly, TiN may improve quenching property of boron. However, a nitrogen content may be advantageously limited to 0.03 wt % or less since an excess of nitrogen may react with boron thereby reducing quenching properties.

Oxygen (O), as used herein, may be contained in an amount of about 0.003 wt % or less but greater than 0 wt % based on the total weight of the steel composition. Oxygen may bind to Si or Al to form non-metallic, oxide-based inclusions, thereby inducing a decrease in fatigue life property. Accordingly, a minimum amount of oxygen may be required in the steel composition. Preferably, the oxygen content may be up to 0.003 wt %.

In addition to the aforementioned components, the ultra high-strength spring steel may include iron (Fe) constituting the remaining balance of the steel composition, and inevitable impurities to form 100%.

Example

Below, a detailed description will be provided with reference to Examples and Comparative Examples.

Preparation

Spring steels of Examples and Comparative Examples were made under a condition for commercially available spring steels. Wire rods from molten steels in which components were used at various contents as shown in FIG. 1 were prepared into steel wires through the consecutive processes of isothermal treatment, wire drawing, quenching-tempering, and solder quenching. Briefly, wire rods were maintained at a temperature of 940 to 960° C. for 3 to 5 min, cooled to a temperature of 640 to 660° C. and maintained at the temperature for 2 to 4 min, followed by cooling to a temperature of 18 to 22° C. for 0.5 to 1.5 min. This isothermal treatment was adapted to facilitate the subsequent wire drawing process. Through the thermal treatment, pearlite was formed in the wire rods.

After the isothermal treatment, the wire rods were subjected to various steps of wire drawing to have a target wire diameter. For example, wire rods with a diameter of 3.3 mm were drawn.

The drawn wire rods were heated to and maintained at a temperature of 940 to 960° C. for 3 to 5 min, and quenched to a temperature of 45 to 55° C., followed by tempering for 0.5 to 1.5 min. Thereafter, the wire rods were again heated to a temperature of 440 to 460° C. and maintained for 2 to 4 min, and then subjected to solder quenching. The formation of martensite by quenching and tempering provided strength for the wire rods while the formation of tempered martensite by solder quenching gave strength and toughness.

Test Examples

In Test Examples, physical properties of the spring steels were examined for the Examples and Comparative Examples.

The spring steels of Examples and Comparative Examples were tested for yield strength, hardness, fatigue strength, moldability, fatigue life, inclusion regulation, and improvement in carbon fraction and carbon activity, and the results are shown in FIG. 2.

In this regard, yield strength and tensile strength were measured using a 20-ton tester on specimens with a diameter of 3.3 mm according to KS B 0802 (KOREAN INDUSTRIAL STANDARDS) and hardness was measured using a micro Vickers hardness tester at 300 gf according to KS B 0811 (KOREAN INDUSTRIAL STANDARDS). Fatigue strength and fatigue life were measured by performing a rotary bending fatigue test on specimens according to KS B ISO 1143 (KOREAN INDUSTRIAL STANDARDS). Moldability was determined to be normal when no breaks occurred when 10,000 valve springs with a diameter/wire diameter of 6.5 and a turn number of 8 were fabricated and molded.

For inclusion regulation, each specimen was rolled parallel, and cut along the median line. Maximum sizes of B- and C-type inclusions present in an area of 60 $mm^2$ of the cut surface were measured using a Max. t-method. Measurement was made under a microscope with 400 to 500-power magnification. A normal state was determined when the steel had inclusions with a size of 10 to 15 μm at a fraction of 10% or less and with a size of 10 μm or less at a fraction of 90% or greater, with no inclusions with a size greater than 15 μm. The B-type inclusions are a plurality of granular inclusions that are discontinuously lined up in a group in a processing direction, and may be, for example, alumina ($Al_2O_3$) inclusions. The C-type inclusions are inclusions that are formed by irregular dispersion without viscous deformation, and may be, for example, silicate ($SiO_2$) inclusions.

The improvement in carbon fraction and carbon activity was calculated using the software ThermoCalc based on a thermodynamic DB. Particularly, the carbon fraction was measured by mapping elemental distributions using SEM-EDX.

Results

As is understood from the data of FIG. 2, the conventional steel that lacked Mo, Ni, V, Nb, Ti, Co, Zr, and Y did not meet any of the requirements of the present disclosure for yield strength, tensile strength, hardness, fatigue strength, moldability, and fatigue life although passing the inclusion regulation.

The steels of Comparative Examples 1 to 16 were different in component content from Examples according to exemplary embodiments of the present invention, and failed to meet any of the requirements of the present invention, although partially improving in yield strength, tensile strength, hardness, fatigue strength, moldability and fatigue life, compared to conventional steel.

Failing to acquire sufficient yield strength, particularly, the steel of Comparative Example 1, which contained a smaller amount of Mo, did not obtain an improvement in hardness, compared to the conventional steel, and rather decreased in fatigue strength and fatigue life.

Comparative Example 6 contained greater content of vanadium than the exemplary embodiment of the present invention, Comparative Example 11 contained less content of boron than the exemplary embodiment of the present invention, and Comparative Example 16 contained greater content of yttrium than the exemplary embodiment of the present invention. Those steels failed in inclusion regulation as their inclusions were coarse or were negatively influenced by the non-uniform molten steel during a steel making process.

In Comparative Example 9, the Ti content was less than the exemplary embodiment of the present invention. As the formation of other inclusions such as $Al_2O_3$ was promoted, the steel had deteriorated fatigue endurance and thus rather decreased in fatigue strength and fatigue life as compared to conventional steel.

Comparative Example 11 contained less content of cobalt than the exemplary embodiment of the present invention and Comparative Example 16 contained greater content of yttrium than the exemplary embodiment of the present invention. Neither of those steels failed in moldability and inclusion regulation as they had deteriorated processability and high-temperature stability or their inclusions were negatively influenced by the non-uniform molten steel during a steel making process.

In contrast, the steels of Examples 1 to 3 contained the components in amounts according to exemplary embodiments of the present invention, and all exhibited a yield strength of 2500 MPa or greater, a tensile strength of 3000 MPa or greater, and a hardness of 750 HV or greater. In addition, all of them were measured to have a fatigue strength of 1200 MPa or greater, and passed the tests for moldability and inclusion regulation. Fatigue life over 500,000 cycles was measured in the steels according to the present disclosure, and they improved in carbon fraction by 7% or greater and in carbon activity by 3% as compared to conventional steel.

FIG. 3 is a graph showing the phase transformation at various temperatures of an exemplary steel composition for the ultra high-strength spring steel according to an exemplary embodiment of the present invention, and FIG. 4 is a graph showing the phase transformation into cementite at various temperatures of an exemplary steel composition for the ultra high-strength spring steel according to an exemplary embodiments of the present invention.

In FIG. 3, the phase transformation of an exemplary steel having an alloy composition of Fe-2.2Si-0.7Mn-0.9Cr-0.66C-0.3Ni-0.3Mo-0.3V-0.15Ti-0.1Co-0.1Zr-0.1Y is shown at temperature ranges. As shown in FIG. 3, the steel has various microinclusions such as CrC and VC, and Ti-rich, or Zr-rich carbides formed during solidification and thus are expected to be improved in strength and fatigue life.

In FIG. 4, the phase transformation of an exemplary steel having an alloy composition of Fe-2.2Si-0.7Mn-0.9Cr-0.66C-0.3Ni-0.3Mo-0.3V-0.15Ti-0.1Co-0.1Zr-0.1Y into cementite is shown in temperature ranges. From the data of FIG. 4, it is understood that the complex behavior of octonary elements in cementite occurs, thus predicting the uniform distribution of microcarbides.

As described herein, the ultra high-strength spring steel that may be obtained from the steel composition according to the present invention may be provided with a tensile strength of 3000 MPa by optimizing contents of main alloy components and with a fatigue strength of 1200 MPa by inclusion refinement. Although the various exemplary embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A steel composition, comprising:
carbon (C) in an amount of 0.5 to 0.7 wt %;
silicon (Si) in an amount of 1.3 to 2.3 wt %;
manganese (Mn) in an amount of 0.6 to 1.2%;
chromium (Cr) in an amount of 0.6 to 1.2 wt %;
molybdenum (Mo) in an amount of 0.1 to 0.5 wt %;
nickel (Ni) in an amount of 0.05 to 0.8 wt %;
vanadium (V) in an amount of 0.05 to 0.5 wt %;
niobium (Nb) in an amount of 0.05 to 0.5 wt %;
titanium (Ti) in an amount of 0.05 to 0.3 wt %;
cobalt (Co) in an amount of 0.01 to 3 wt %;
zirconium (Zr) in an amount of 0.001 to 0.2 wt %;
yttrium (Y) in an amount of 0.016 to 1.48 wt %;
copper (Cu) in an amount of 0.3% or less but greater than 0 wt %;
aluminum (Al) in an amount of 0.3% or less but greater than 0 wt %;
nitrogen (N) in an amount of 0.03% or less but greater than 0 wt %;
oxygen (O) in an amount of 0.003% or less but greater than 0 wt %; and
iron (Fe) constituting the remaining balance of the steel composition,
all the wt % based on the total weight of the steel composition,
wherein the steel composition has a tensile strength of 3000 MPa or greater,
wherein the steel composition has a hardness of 750 HV or greater, and
wherein the steel composition has a fatigue strength of 1262 MPa or greater.

2. The steel composition of claim 1, wherein the steel composition has a yield strength of 2500 MPa or greater.

3. The steel composition of claim 1, wherein the steel composition contains inclusions and the inclusions have a size of 15 μm or less.

4. The steel composition of claim 3, wherein a fraction of 10% or less of the inclusions have a size of 10 to 15 μm and a fraction of 90% or greater of the inclusions have a size of 10 μm.

5. The steel composition of claim 1, consisting essentially of:
carbon (C) in an amount of 0.5 to 0.7 wt %;
silicon (Si) in an amount of 1.3 to 2.3 wt %;
manganese (Mn) in an amount of 0.6 to 1.2%;
chromium (Cr) in an amount of 0.6 to 1.2 wt %;
molybdenum (Mo) in an amount of 0.1 to 0.5 wt %;
nickel (Ni) in an amount of 0.05 to 0.8 wt %;
vanadium (V) in an amount of 0.05 to 0.5 wt %;
niobium (Nb) in an amount of 0.05 to 0.5 wt %;
titanium (Ti) in an amount of 0.05 to 0.3 wt %;
cobalt (Co) in an amount of 0.01 to 3 wt %;
zirconium (Zr) in an amount of 0.001 to 0.2 wt %;
yttrium (Y) in an amount of 0.016 to 1.48 wt %;
copper (Cu) in an amount of 0.3% or less but greater than 0 wt %;
aluminum (Al) in an amount of 0.3% or less but greater than 0 wt %;
nitrogen (N) in an amount of 0.03% or less but greater than 0 wt %;
oxygen (O) in an amount of 0.003% or less but greater than 0 wt %; and
iron (Fe) constituting the remaining balance of the steel composition,
all the wt % based on the total weight of the steel composition,
wherein the steel composition has a tensile strength of 3000 MPa or greater, and
wherein the steel composition has a hardness of 750 HV or greater, and
wherein the steel composition has a fatigue strength of 1262 MPa or greater.

6. The steel composition of claim 1, consisting of:
carbon (C) in an amount of 0.5 to 0.7 wt %;
silicon (Si) in an amount of 1.3 to 2.3 wt %;
manganese (Mn) in an amount of 0.6 to 1.2%;

chromium (Cr) in an amount of 0.6 to 1.2 wt %;
molybdenum (Mo) in an amount of 0.1 to 0.5 wt %;
nickel (Ni) in an amount of 0.05 to 0.8 wt %;
vanadium (V) in an amount of 0.05 to 0.5 wt %;
niobium (Nb) in an amount of 0.05 to 0.5 wt %;
titanium (Ti) in an amount of 0.05 to 0.3 wt %;
cobalt (Co) in an amount of 0.01 to 3 wt %;
zirconium (Zr) in an amount of 0.001 to 0.2 wt %;
yttrium (Y) in an amount of 0.016 to 1.48 wt %;
copper (Cu) in an amount of 0.3% or less but greater than 0 wt %;
aluminum (Al) in an amount of 0.3% or less but greater than 0 wt %;
nitrogen (N) in an amount of 0.03% or less but greater than 0 wt %;
oxygen (O) in an amount of 0.003% or less but greater than 0 wt %; and
iron (Fe) constituting the remaining balance of the steel composition,
all the wt % based on the total weight of the steel composition,
wherein the steel composition has a tensile strength of 3000 MPa or greater, and
wherein the steel composition has a hardness of 750 HV or greater, and
wherein the steel composition has a fatigue strength of 1262 MPa or greater.

7. A valve spring steel that comprises a steel composition of claim 1.

8. A vehicle part that comprises a steel composition of claim 1.

9. The vehicle part of claim 8, wherein the vehicle part is a valve spring steel in a vehicle engine.

* * * * *